US007303002B2

(12) United States Patent
Usui et al.

(10) Patent No.: US 7,303,002 B2
(45) Date of Patent: Dec. 4, 2007

(54) FIN STRUCTURE, HEAT-TRANSFER TUBE HAVING THE FIN STRUCTURE HOUSED THEREIN, AND HEAT EXCHANGER HAVING THE HEAT-TRANSFER TUBE ASSEMBLED THEREIN

(75) Inventors: Shoichiro Usui, Numazu (JP); Tadahiro Goto, Fuji (JP)

(73) Assignee: USUI Kokusai Sangyo Kaisha Limited (JP)

( * ) Notice: Subject to any disclaimer, the term of this patent is extended or adjusted under 35 U.S.C. 154(b) by 117 days.

(21) Appl. No.: 11/221,235

(22) Filed: Sep. 7, 2005

(65) Prior Publication Data

US 2006/0048921 A1 Mar. 9, 2006

(30) Foreign Application Priority Data

Sep. 8, 2004 (JP) ..... 2004-261176

(51) Int. Cl.
*F28F 1/42* (2006.01)

(52) U.S. Cl. ..... 165/109.1; 165/183

(58) Field of Classification Search ..... 165/107.1, 165/183, 152, 153, 166, 167, 177, 179, 185
See application file for complete search history.

(56) References Cited

U.S. PATENT DOCUMENTS 3,451,473 A * 6/1969 Urie et al. ..... 165/166
3,521,707 A * 7/1970 Brown ..... 165/152
3,636,607 A * 1/1972 DeMarco ..... 29/890.036
4,059,882 A * 11/1977 Wunder ..... 165/140
5,560,424 A * 10/1996 Ogawa ..... 165/183
2002/0174979 A1* 11/2002 Haegele et al. ..... 165/177
2004/0099408 A1* 5/2004 Shabtay et al. ..... 165/177

FOREIGN PATENT DOCUMENTS

JP 11-23181 1/1999
JP 2000-111277 4/2000
JP 2002-107091 4/2002

* cited by examiner

*Primary Examiner*—Teresa J. Walberg
(74) *Attorney, Agent, or Firm*—Gerald E. Hespos; Anthony J. Casella

(57) ABSTRACT

A fin structure, a heat-transfer tube and a heat exchanger are formed of plate fins housed in a heat-transfer tube and have an excellent cooling efficiency by making the distribution and flow velocity of a flow uniform and by promoting an efficient heat-exchanging action. The fin structure includes plate fins housed in a heat-transfer tube and having a square section and a free shape in the longitudinal direction for dividing a passage for a fluid composed of a cooled medium or a cooling medium to flow in the heat-transfer tube, into a plurality of small passages. In the fin structure, notches, through holes, raised portions, ridges and/or troughs are formed in the sides or the upper or lower walls of the plate fins. The heat-transfer tube has the fin structure housed therein. The heat exchanger has the heat-transfer tube assembled therein.

12 Claims, 10 Drawing Sheets

FIN STRUCTURE, HEAT-TRANSFER TUBE HAVING THE FIN STRUCTURE HOUSED THEREIN, AND HEAT EXCHANGER HAVING THE HEAT-TRANSFER TUBE ASSEMBLED THEREIN

BACKGROUND OF THE INVENTION

1. Field of the Invention

The present invention relates to a fin structure for stirring a fluid in a heat exchanger and, more particularly, to: a fin structure, which is housed in a heat-transfer tube of a heat-exchanging type cooling apparatus for causing a stirring action to establish turbulent flows or vortex flows in a fluid of a cooled medium or a cooling medium flowing in the heat-transfer tube thereby to enlarge the contact between the heat-transfer tube wall and the fluid, and for making the flow velocity or flow rate of the fluid flowing in the heat-transfer tube uniform thereby to obtain an excellent heat-exchanging function; a heat-transfer tube for a heat exchanger having the fin structure housed therein; and a heat exchanger having the heat-transfer tube assembled therein.

2. Description of Related Art

In recent years, many heat exchangers for fluids of various modes such as liquid-liquid, liquid-gas or gas-gas have been used as not only an EGR cooler for recirculating the exhaust gas of an automobile but also an exhaust gas cooler, a fuel cooler, an oil cooler, an inter cooler, or the like. Various devices have been made in the heat-transfer tube, in which those fluids flow, thereby to efficiently radiate or absorb the heat owned by the fluid. For example, the method, in which the exhaust gas is partially extracted from the exhaust system of a Diesel engine and is returned again to the intake system of the engine and added to the air-fuel mixture, is called the "EGR (Exhaust Gas Recirculation)" to suppress emissions of NOx (nitrogen oxides) thereby to attain many effects to reduce the pump loss and the radiation loss to the cooling liquid, as accompanies the temperature drop of the combustion gas, to increase the specific heat due to the change in the amount/composition of the working gas and to improve the cycle efficiency accordingly. Therefore, the EGR has been widely adopted as the method effective for cleaning the exhaust gas of the Diesel engine or for improving the thermal efficiency.

However, as the EGR gas rises in temperature and increases in flow rate, its thermal action degrades the durability of the EGR valve and may damage the EGR valve early. For this countermeasure against this problem, a water-cooled structure has to be made by providing a cooling system. There is also invited a phenomenon that the charging efficiency is dropped to lower the mileage as the intake temperature rises. In order to avoid this situation, an apparatus has been used to cool the EGR gas with an engine cooling liquid, a car air-conditioning coolant, cooling wind and the like. Of these, there have been proposed many EGR gas cooling apparatus of the gas-liquid heat-exchanging type for cooling the gas or the EGR gas with the engine cooling water. Fins of various modes are housed as means for improving the heat-exchanging performance in the tubes for the EGR gas to flow therein. Of these EGR gas cooling apparatus of the gas-liquid heat-exchanging type, such an EGR gas cooling apparatus of a dual tube heat-exchanging type has been still earnestly demanded as has a simple structure so that it can be easily mounted in a narrow installation space. For example, there have been many dual-tube type heat exchangers including a dual-tube type heat exchanger (as referred to JP-A-11-23181 (pages 1 to 6, FIGS. 1 and 2), for example), in which an outer tube for passing a liquid is arranged around an inner tube for passing a hot EGR gas thereby to perform the heat exchange between the gas and the liquid and in which corrugated metal sheets are inserted as fins in the inner tube, and a dual-tube type heat exchanger (as referred to JP-A-2000-111277 (pages 1 to 12, FIGS. 1 to 12), for example), which includes an inner tube for passing the cooled medium therein, an outer tube space to enclose the outer circumference of the inner tube, and radiating fins arranged in the inner tube and having a thermal stress relaxing function.

According to the dual-tube type heat exchanger having the variously improved fin structure housed therein, the excellent cooling efficiency can be reasonably expected despite of the simple and compact structure. Therefore, many dual-type heat exchangers have already been put into practice as the EGR-gas cooling heat exchanger, the mounting space of which is limited as in a small-sized automobile. Because of the compact structure, the absolute flow rate of the fluid is limited by itself thereby to leave an unsolved problem in the total heat-exchanging amount. In order to solve this problem, the so-called "shell-and-tube type heat exchanger" has to be adopted although it is more or less complicated in structure and has to be large-sized. Various improvements have been done on those heat exchangers. In one example of the shell-and-tube type heat exchanger, a cooling water inlet is attached to one end of the outer circumference of a shell body constituting a cooling jacket, and a nozzle for a cooling water outlet is attached to the other end of the same. A bonnet for introducing a hot EGR gas is integrated with one longitudinal end of the shell body, and a bonnet for discharging the heat-exchanged EGR gas is integrated with the other end of the same. A plurality of flat heat-transfer tubes are attached at a spacing through tube sheets attached to the inner sides of the individual bonnets so that the hot EGR gas flows in the flat heat-transfer tube across the cooling water flowing in the shell body. In addition to the wide heat-transfer area formed by those flat heat-transfer tubes, C-shaped plate fins are fitted on the inner circumferences of the flat heat-transfer tubes thereby to thin the EGR gas flows and to increase the heat transfer area more. Thus, the shell-and-tube type heat exchanger having the excellent heat-exchanging efficiency is disclosed (as referred to JP-A-2002-107091 (pages 1 to 3, FIGS. 1 to 3), for example).

In the aforementioned individual related arts, considerable effects can be expected in that the gas flow is refined to increase the contact area with the corrugated fins or cross fins by housing the fins in the dual-tube type EGR gas cooler, as disclosed in JP-A-11-23181 and JP-A-2000-111277. However, most pipes forming the EGR gas passages have smooth inner circumferences all over the length of the lengthwise direction so that the heat transfer near the centers of the pipes is insufficient. Moreover, the gas flows straight along the EGR gas piping so that the turbulences of the gas flow are insufficient for thinning the boundary layer of the heat-transfer face thereby to make the heat-transferring performance insufficient. In addition, the compact dual-tube structure leaves such a problem unsolved that the absolute value of the calorie to be exchanged is short. In the shell-and-tube type heat exchanger disclosed in JP-A-2002-107091, the plate fins housed in the flat tube are formed straight with respect to the gas flow. As a result, the fluid is so insufficiently stirred that the separation of the streamlines and the stirring effect of the fluid cannot be said sufficient.

In recent years, moreover, a shell-and-tube type heat exchanger 20, as shown in FIG. 16, is widely adopted not only as the aforementioned EGR gas cooling apparatus but also one example of the heat-exchanging type cooling apparatus including that EGR gas cooling apparatus. In the shell-and-tube type heat exchanger 20, a heat-transfer tube group 23 is formed in a shell 21 for the cooling water to flow therein through tube sheets 25 by a plurality of heat-transfer tubes. The hot fluid, as introduced from a cooled medium inlet g1 formed in a bonnet 22-1, is discharged from a cooled medium outlet g2 disposed in a bonnet 22-2 on the opposite side. In this meanwhile, the hot fluid is heat-exchanged with the cooling water, which flows in the shell 21 through the wall of the heat-transfer tubes forming the heat-transfer tube group 23 in a direction perpendicular to the flow of the cooled medium, so that the hot fluid is cooled to a predetermined temperature. Moreover, individual heat-transfer tubes 23-1 forming the heat-transfer tube group 23 are flattened, as shown in FIGS. 17A to 17C, to enlarge their contact areas. Corrugated plate fins 26, which have a square section and a free shape in the longitudinal direction, are fitted in the flat heat-transfer tube 23-1 thereby to define the passage of the hot fluid or the cooled medium into a plurality of small passages. The plate fins 26 are undulated, as shown in FIG. 17C, to meander the fluid to flow in the small passages thereby to enlarge the heat transfer area. Thus, those fin structures for improving the heat-exchanging efficiency better have been proposed to achieve their individual initial effects. In the heat-transfer tubes having the fin structure formed by subjecting the plate material of a single thin metallic sheet in the flat heat-transfer tube to a special plastic treatment, however, the pressure loss of the fluid in the small passages formed by the fin structure is so low that the fluid to flow between the small passages is not uniformly distributed to make an ununiform distribution in the flow velocity. Moreover, the small passages, which are divided by the plate fins formed of the single metallic thin plate, form the individually independent passages but do not communicate with each other. Therefore, the ununiform distribution of the flow velocity, if once caused, cannot be eliminated to leave such a problem unsolved that the heat-exchanging efficiency is seriously lowered due to that deviation of the flow velocity distribution. Moreover, the ununiformity of the fluid distribution in the divided small passages in the heat-transfer tubes makes it impossible to cool the flowing excess fluid, if any, to the desired temperature range. In case the fluid flow is short, on the other hand, the cooling of the fluid proceeds, but the fluid fails to reach the predetermined flow rate so that the exchanged calorie is resultantly reduced. Even in the aforementioned fin structure improved to raise the heat-exchanging efficiency, difficulties are encountered by the working or mounting method of the fin structure such as the complicated plastic working so that a sufficient performance cannot be attained. The serious problem left unsolved is to make more improvements.

SUMMARY OF THE INVENTION

The invention has a desired object to solve those problems and to provide a fin structure, which is fitted in a flat heat-transfer tube and made excellent in the heat-exchanging efficiency even with a simple structure by improving it, a heat-exchanging heat-transfer tube having the fin structure fitted therein, and a heat exchanger having the heat-transfer tube assembled therein.

In order to solve the problems, according to one aspect of the invention, there is provided a fin structure comprising plate fins housed in a heat-transfer tube and having a square section and a free shape in the longitudinal direction for dividing a passage for a fluid composed of a cooled medium or a cooling medium to flow in said heat-transfer tube, into a plurality of small passages, characterized in that at least one of notches, through holes, raised portions, ridges and troughs, and so on is formed in the sides or the upper or lower walls of said plate fins.

Moreover, the fin structure according to the invention is characterized in that said heat-transfer tube is a flat tube, and in that said plural small passages formed by the plate fins housed in said flat heat-transfer tube and having a square section and a free shape in the longitudinal direction are curved or straight in the longitudinal direction.

In a preferred aspect of the fin structure according to the invention, moreover, the plate fins are individually made of a plate material of one metal thin sheet, and in that the means for forming the notches, through holes, raised portions, ridges and troughs and so on in said plate material is either a mechanical working method such as a press working or a chemical working method such as an etching.

In a preferred aspect of the fin structure according to the invention, means for housing the plate fins in the heat-transfer tube is suitably selected from the welding, soldering or other jointing means and the plate fins are integrally jointed to the heat-transfer tube.

According to another aspect of the invention, there is provided a heat-transfer tube characterized in that a fin structure, which includes plate fins housed in a heat-transfer tube and having a square section and a free shape in the longitudinal direction for dividing a passage for a fluid composed of a cooled medium or a cooling medium to flow in the heat-transfer tube, into a plurality of small passages and in which at least one of notches, through holes, raised portions, ridges and troughs, and so on is formed in the sides or the upper or lower walls of said plate fins, is housed in the tube.

In the heat-transfer tube according to the invention, moreover, the heat-transfer tube is a flat tube, and the plural small passages formed by the plate fins housed in the flat heat-transfer tube and having a square section and a free shape in the longitudinal direction are curved or straight in the longitudinal direction.

In a preferred aspect of the heat-transfer tube, moreover, the fin structures housed in the heat-transfer tube are individually made of a plate material of one metal thin sheet, and means for forming the notches, through holes, raised portions, ridges and troughs and so on in the plate material is either a mechanical working method such as a press working or a chemical working method such as an etching.

In a preferred aspect of the heat-transfer tube according to the invention, means for housing the fin structure in the heat-transfer tube is suitably selected from the welding, soldering or other jointing means and the plate fins are integrally jointed to the heat-transfer tube.

According to still another aspect of the invention, there is provided a heat exchanger which is characterized by comprising at least one of such flat heat-transfer tubes assembled therein that the fin structure comprising plate fins housed in a heat-transfer tube and having a square section and a free shape in the longitudinal direction for dividing a passage for a fluid composed of a cooled medium or a cooling medium to flow in said heat-transfer tube, into a plurality of small passages and that at least one of notches, through holes, raised portions, ridges and troughs, and so on is formed in the sides or the upper or lower walls of said plate fins.

According the foregoing fin structure of the invention, at least one notch, through hole, raised portion, ridge and trough and the like is formed on the side or the upper or lower wall of the plate fin which is housed in the flat heat-transfer tube and which divides the passage of the fluid either the cooled medium or the cooling medium to flow in the heat-transfer tube into the plural small passages having the square section and the free shape in the longitudinal direction. In the adjoining small passages, the flowing fluids flow into each other so that the flow of the direction perpendicular to the flow in the flat heat-transfer tube is freed. As a result, no deviation in the flow velocities of the flows in the small passages divided from the heat-transfer tube is established to make the accompanying distribution ununiform in the flow velocity. Thus, the structure can keep the uniform flow velocity. Moreover, the pressure of the fluid is uniform between the individual passages divided into the small passages so that the distribution of the fluid is averaged to improve the heat-exchanging performance. Here, in the fin structure having at least one ridge or trough formed in the side or the upper or lower wall of the plate fin having the square section for forming the fin structure, the mutual communication between the fluids in the partitioned small passages is impossible. However, the ridge or trough formed in the wall portion, i.e., in the curved corner portion effectively acts on the streamlines of the fluid so that an excellent stirring effect can be obtained. By forming the aforementioned notches, through holes, raised portions or the like supplementarily in the side walls, moreover, not only the aforementioned communication phenomenon between the fluids but also a heat-exchanging performed can be obtained to expect an excellent cooling efficiency.

According to the flat heat-transfer tube having the fin structure of the invention housed therein, moreover, the fluid can freely flow into and out of the small passages divided and partitioned by the notches, the through holes, the raised portions, the ridges and troughs, and so on formed in the sides of the fin structure. As a result, the mixing and collision between the fluids frequently can occur to establish the turbulences and vortexes of the working fluid, and the flow lines of the fluid are complicatedly disturbed to separate the laminar flow to repeat the effective stirring actions so that the fluid to flow in the heat-transfer tube can repeat the contact with the heat-transfer tube wall and the fins thereby to cause the heat exchange effectively. In addition, the end portions to be formed of the aforementioned notches, through holes, raised portions, the ridges and troughs and so on cause the heat-exchanging edge effects so that the heat-exchanging performance can be better improved. Thus, the fin structure according to the invention can be properly housed as the fluid stirring plate fin in not only the shell-and-tube type heat-exchanging cooling apparatus but also the exhaust gas cooler, or the heat-exchanging heat-transfer tube of an EGR gas cooler, a fuel cooler, an oil cooler or an inter cooler. At the same time, the heat-transfer tube having the fin structure housed therein and the heat exchanger of the invention having the heat-transfer tube assembled therein is enabled to reduce the sizes and weights of those apparatus by their excellent heat-exchanging performance and to contribute the compactness of the apparatus. Thus, the heat exchanger, which can be easily installed in a limited space, can be provided at a relatively low cost.

BRIEF DESCRIPTION OF THE DRAWINGS

FIGS. 1A and 1B show a fin structure according to one embodiment of the invention and a single unit of a flat heat-transfer tube having the fin structure housed therein, wherein FIG. 1A presents a front elevation, and FIG. 1B presents a schematic perspective view of the essential portion.

FIGS. 10A to 10C show an essential portion of a single unit of a fin structure according to a sixth embodiment according to the invention, wherein FIG. 10A presents a top plan view; FIG. 10B presents a side elevation; and FIG. 10C presents a front elevation.

FIGS. 17A to 17C show a flat heat-transfer tube, which is mounted in the aforementioned heat exchanger and which has corrugated fins of a square section housed therein, and a cooling jacket (or shell body), wherein FIG. 17A presents a section taken along line A-A of FIG. 16; FIG. 17B presents a front elevation showing a flat heat-transfer tube itself; and FIG. 17C presents a top plan view of the plate fin housed in the flat heat-transfer tube.

DESCRIPTION OF PREFERRED EMBODIMENTS

Embodiments of the invention will be described in more detail with reference to the accompanying drawings.

Figure 1A:
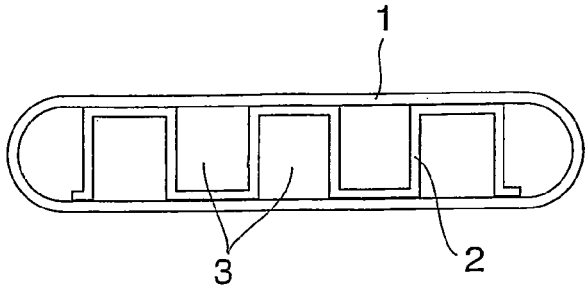
Figure 1B:
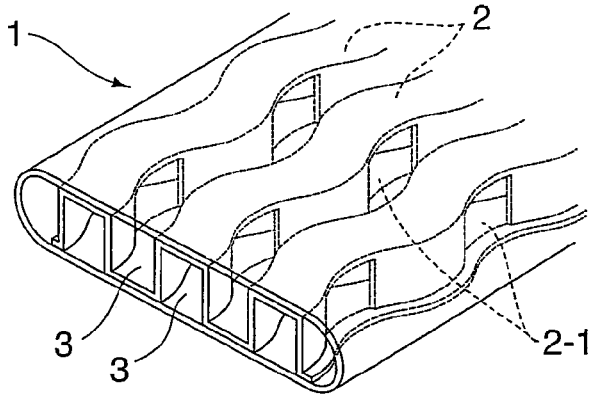

FIGS. 1A and 1B show a fin structure according to one embodiment of the invention and a single unit of a flat heat-transfer tube having the fin structure housed therein.

Figure 2:
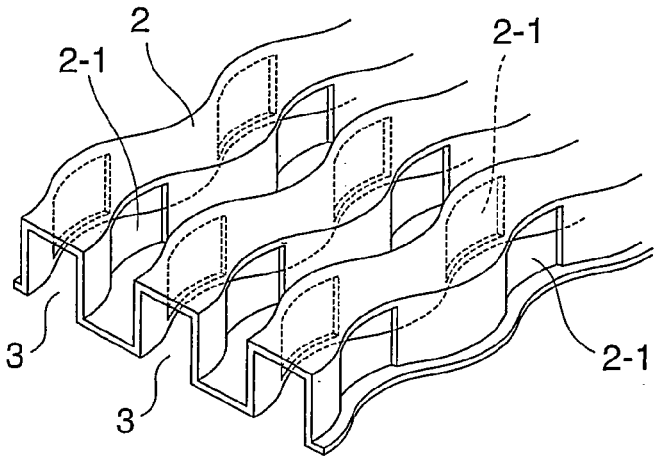
FIG. 2 is an enlarged perspective view of an essential portion of the fin structure housed in the same embodiment.
Figure 3:
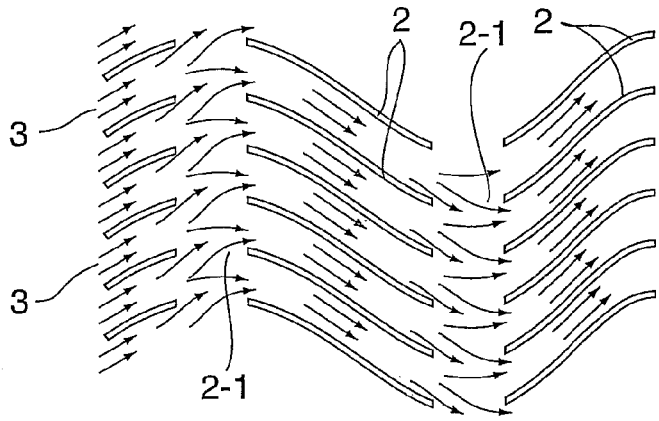
FIG. 3 is a schematic top plan view of the same embodiment showing a portion of the flow of a hot fluid to flow in the heat-transfer tube.
Figure 4:
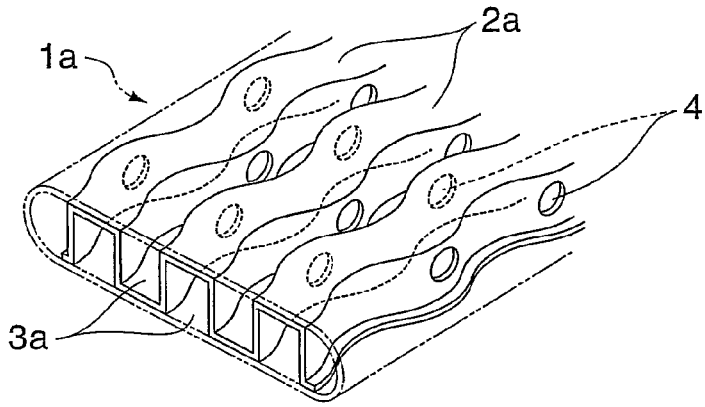
FIG. 4 shows a fin structure according to a second embodiment of the invention and a single unit of a flat heat-transfer tube having the fin structure housed therein, and presents a perspective view of the essential portion.
Figure 5:
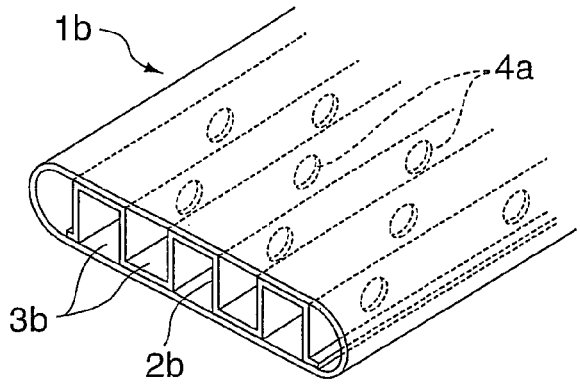
FIG. 5 shows a fin structure according to a third embodiment of the invention and a single unit of a flat heat-transfer tube having the fin structure housed therein, and presents a schematic perspective view of the essential portion.
Figure 6:
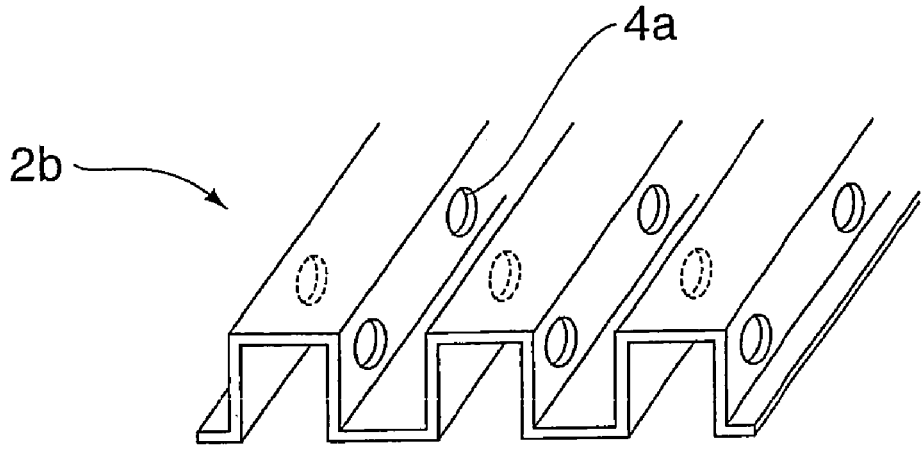
FIG. 6 is an enlarged perspective view showing an essential portion of a fin structure housed in the same embodiment.
Figure 7:
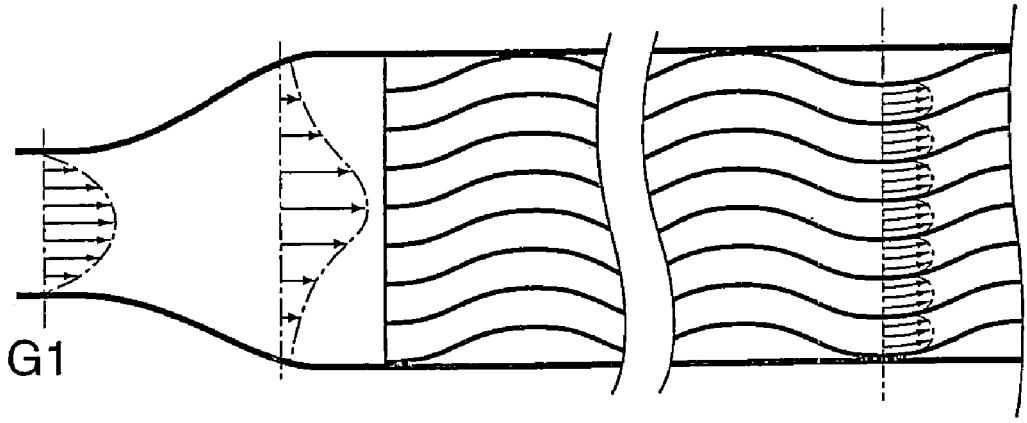
FIG. 7 presents a fluid distribution state and a flow velocity distribution of a hot fluid in the same embodiment.
Figure 8:
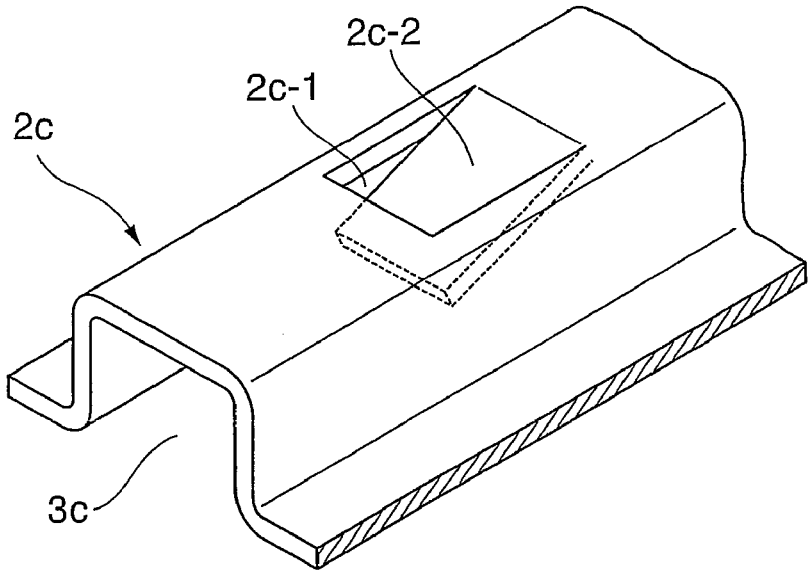
FIG. 8 is a schematic perspective view showing an essential portion of a fin structure of a fourth embodiment according to the invention.
Figure 9:
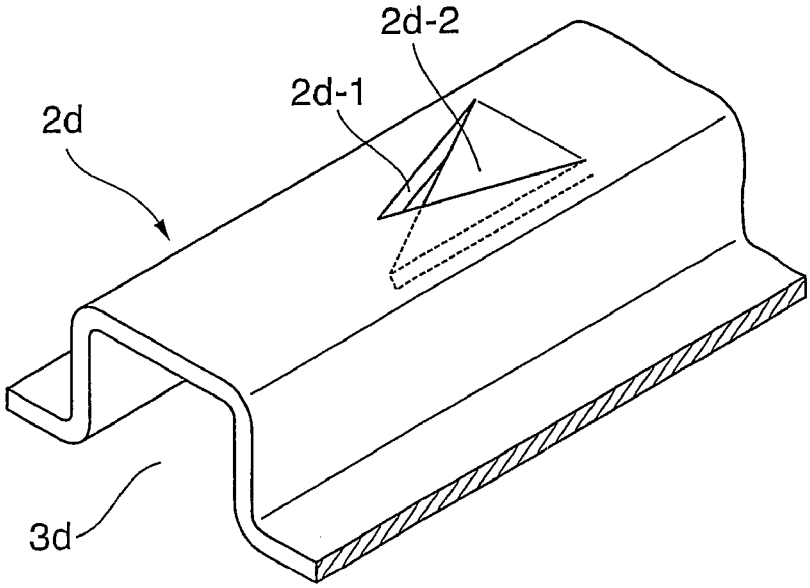
FIG. 9 is a schematic perspective view showing an essential portion of a fin structure of a fifth embodiment according to the invention.
Figure 10A:
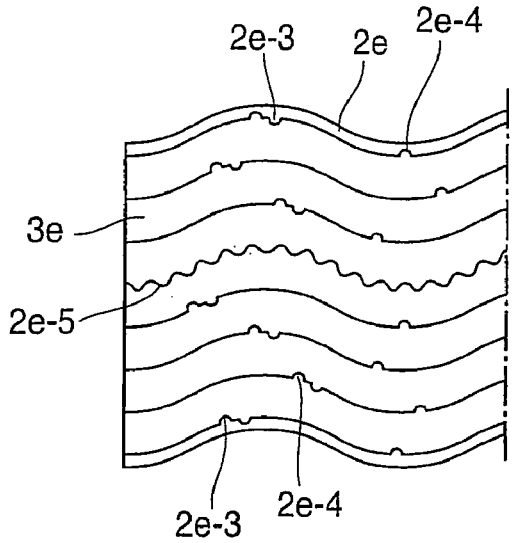
Figure 10B:
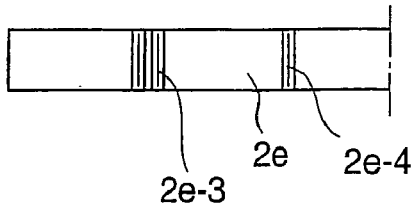
Figure 10C:
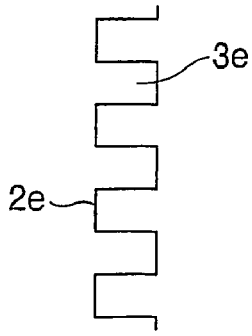
Figure 11:
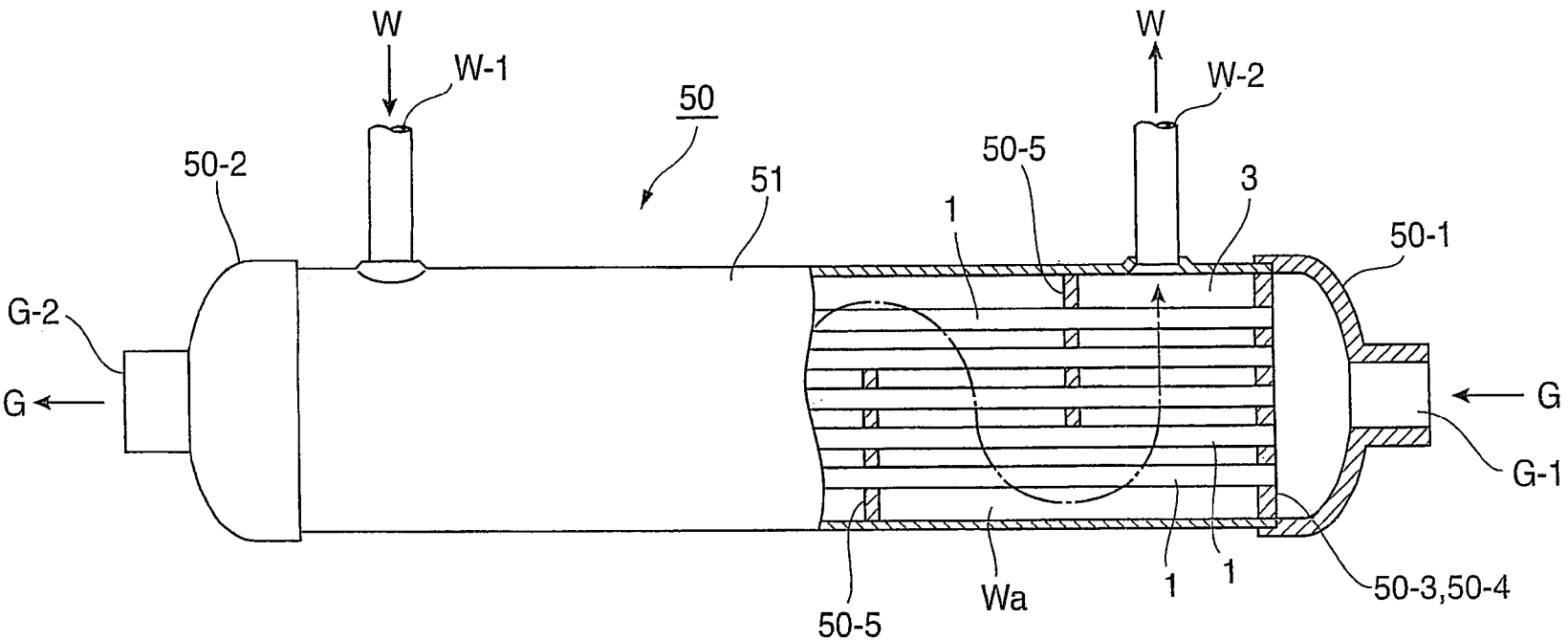
FIG. 11 is a partially broken front elevation showing a shell-and-tube type heat exchanger according to a seventh embodiment of the invention.
Figure 12:
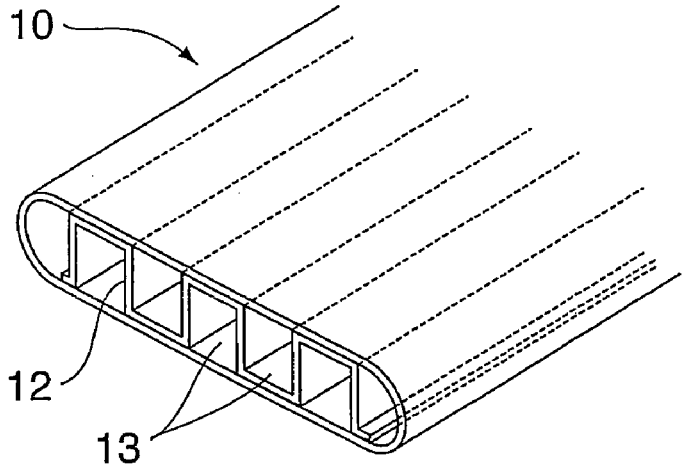
FIG. 12 is a perspective view showing an essential portion of a plate fin of a first comparison according to the invention and a single unit of a flat heat-transfer tube having the plate fin housed therein.
Figure 13:
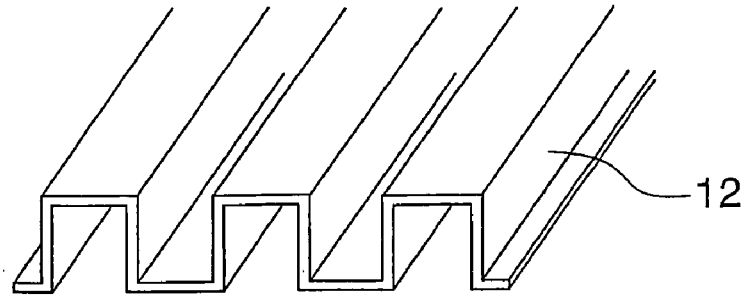
FIG. 13 PRIOR ART
FIG. 13 is an enlarged perspective view of an essential portion of the plate fin to be housed in the same comparison.
Figure 14:
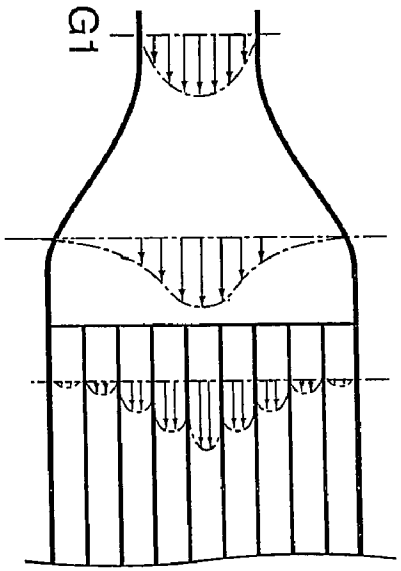
FIG. 14 PRIOR ART
FIG. 14 presents a fluid distribution state and a flow velocity distribution of a hot fluid in the same comparison.
Figure 15:
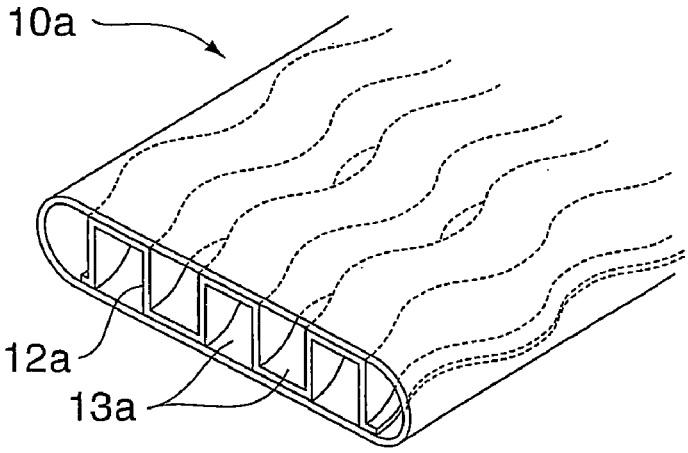
FIG. 15 PRIOR ART
FIG. 15 is a perspective view showing an essential portion of a plate fin of a second comparison according to the invention and a single unit of a flat heat-transfer tube having the plate fin housed therein.
Figure 16:
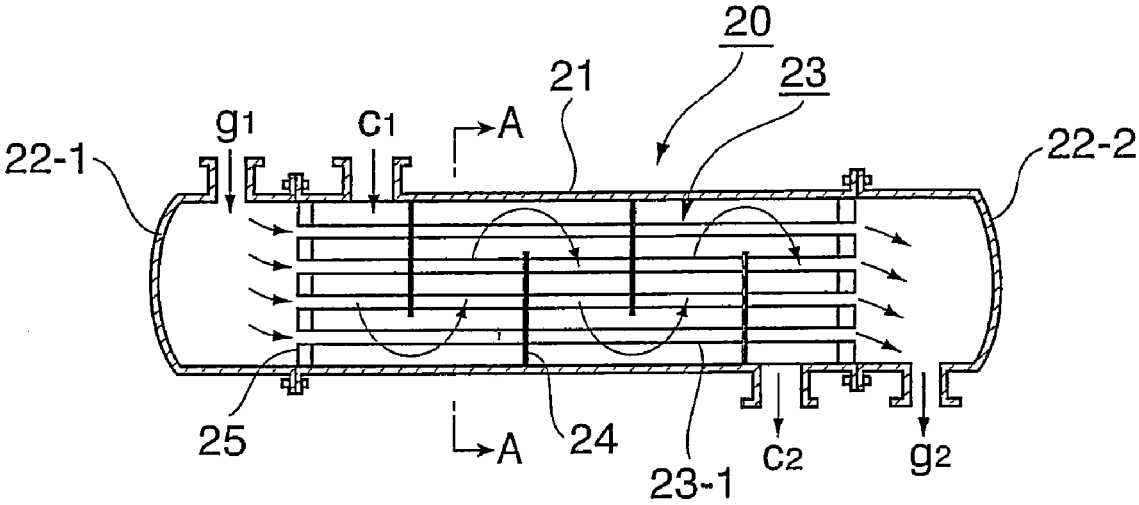
FIG. 16 PRIOR ART
FIG. 16 is a schematic side elevation for explaining a shell-and-tube type heat exchanger of the related art.
Figure 17A:
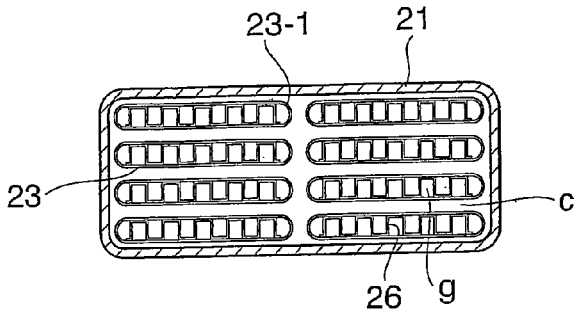
FIG. 17A PRIOR ART
Figure 17B:
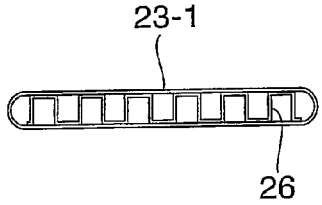
FIG. 17B PRIOR ART
Figure 17C:
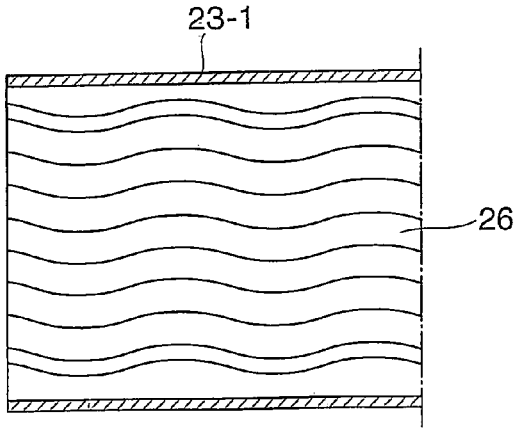
FIG. 17C PRIOR ART

FIG. 1A presents a front elevation, and FIG. 1B presents a schematic perspective view of the essential portion. FIG. 2 is an enlarged perspective view of an essential portion of the fin structure housed in the same embodiment. FIG. 3 is a schematic top plan view of the same embodiment showing a portion of the flow of a hot fluid to flow in the heat-transfer tube. FIG. 4 shows a fin structure according to a second embodiment of the invention and a single unit of a flat heat-transfer tube having the fin structure housed therein, and presents a schematic perspective view of the essential portion. FIG. 5 shows a fin structure according to a third embodiment of the invention and a single unit of a flat heat-transfer tube having the fin structure housed therein, and presents a schematic perspective view of the essential portion. FIG. 6 is an enlarged perspective view showing an essential portion of a fin structure housed in the same embodiment. FIG. 7 presents a fluid distribution state and a flow velocity distribution of a hot fluid in the same embodiment. FIG. 8 is a schematic perspective view showing an essential portion of a fin structure of a fourth embodiment according to the invention. FIG. 9 is a schematic perspective view showing an essential portion of a fin structure of a fifth embodiment according to the invention. FIGS. 10A to 10C show an essential portion of a single unit of a fin structure according to a sixth embodiment according to the invention. FIG. 10A presents a top plan view; FIG. 10B presents a side elevation; and FIG. 10C presents a front elevation. FIG. 11 is a partially broken front elevation showing a shell-and-tube type heat exchanger according to a seventh embodiment of the invention. FIG. 12 is a perspective view showing an essential portion of a plate fin of a first comparison according to the invention and a single unit of a flat heat-transfer tube having the plate fin housed therein. FIG. 13 is an enlarged perspective view of an essential portion of the plate fin to be housed in the same comparison. FIG. 14 presents a fluid distribution state and a flow velocity distribution of a hot fluid in the same comparison. FIG. 15 is a perspective view showing an essential portion of a plate fin of a second comparison according to the invention and a single unit of a flat heat-transfer tube having the plate fin housed therein.

Embodiments

The invention will be described in more detail in connection with its embodiments. However, the invention should not be restricted by the embodiments, but its design can be freely designed within the scope of the gist thereof.

Embodiment 1

In the plate fin according to the first embodiment of the invention, a plurality of plate members were obtained by working a thin sheet made of austenite stainless steel SUS304 of a thickness of 0.2 mm, as shown in FIGS. 1A and 1B, into a square of a predetermined size, and predetermined notches 2-1 were formed by punching eight sheets of the plate members with a press. Next, the plate members were subjected to a plastic working to fabricate a fin structure 2 having a rectangular section having corrugations in the longitudinal direction and the plural notches 2-1 in its sides, as shown in FIG. 2. The fin structure 2 thus obtained was inserted into a flat heat-transfer tube 1 made of an identical material and having a thickness of 0.5 mm, and was jointed with a solder into an integral structure so that it was divided into a plurality small passages 3 having the square sections in the flat heat-transfer tube 1 and the corrugations in the longitudinal direction. Here, the plural notches 2-1 were formed in the side walls of the small passages 3 by the aforementioned press working so that the adjoining small passages 3 divided communicated with each other. Eight flat heat-transfer tubes thus formed were prepared and assembled as the gas passages in the EGR gas cooling apparatus (although not shown) in the cooling jacket. This cooling jacket was subjected to the cooling performance tests, and the test results were compared with those of the related art based on Comparison 1 and are presented in Table 1. From the results enumerated in Table 1, the following items have been confirmed. In the case of the invention, the EGR gas was allowed to flow in and out between the adjoining small passages 3 by the action of the housed fin structure so that its pressure was made uniform between the small passages 3. As shown in FIG. 7, the flow distribution and the flow velocity distribution of the EGR gas to flow in small passages 3*b* of a heat-transfer tube 1*b* were held homogenous, as shown in FIG. 7, the heat exchange to the cooling jacket around the heat-transfer tube was effectively promoted to have a high temperature efficiency.

TABLE 1

| | Test Conditions | | | | | |
|---|---|---|---|---|---|---|
| | Water Flow Rate (g/sec) | Water Temp. (° C.) | Gas Inlet Temp. (° C.) | Gas Outlet Temp. (° C.) | Pressure Loss (kpa) | Temp. Efficiency (%) |
| Invention | 20 | 80 | 400 | 106 | 1.1 | 92 |
| Related Art | 20 | 80 | 400 | 138 | 1.3 | 82 |

The plate material for forming the aforementioned fin structure 2 according to the embodiment adopted the thin sheet of austenite stainless steel SUS304. It is, however, not precluded from suitably selecting any other metallic material, if this is a material having a predetermined mechanical strength, excellent in heat resistance, corrosion resistance and heat transfer, and a satisfactory workability. Moreover, means for forming the notches 2-1 in the embodiment was the punching with the press. However, the method of shaping the notches may use a mechanical cutting, a laser or an electric discharge machining. Moreover, the notches can also be formed by masking the plate material and by etching it in a corrosive solution with chemical means.

Embodiment 2

As shown in FIG. 4, a corrugated fin structure 2*a* was prepared like Embodiment 1, excepting that circular through holes 4 were formed in place of the notches 2-1 of Embodiment 1 in the side walls of small passages 3*a* formed by the fin structure 2*a*. The fin structure 2*a* obtained was integrally jointed to a flat heat-transfer tube like that of Embodiment 1 by similar means so that eight heat exchanger flat heat-transfer tubes 1*a* each having the fin structure 2*a* were obtained, as shown in FIG. 4. Next, the heat-transfer tube 1*a* was assembled into the EGR gas cooling apparatus as in Embodiment 1 and was subjected to the cooling tests under the same conditions as those of Embodiment 1. The results have revealed that a cooling efficiency substantially equivalent to that of Embodiment 1 was obtained.

Embodiment 3

A fin structure 2*b*, as shown in FIG. 6, was prepared like Embodiment 2 excepting that the its shape of the plate material was straight in the longitudinal direction. Here, means for preparing the fin structure 2*b* did need any complicated plastic working but could be sufficed by a simple press working as in the punching of through holes 4*a*, so that the cost for manufacturing the fin structure 2*b* could be drastically lowered. The fin structure 2*b* was inserted into a flat heat-transfer tube like that of Embodiment 2 and was integrally jointed by similar means so that eight flat heat-transfer tubes 1*b* each having the fin structure 2*b* housed therein were manufactured, as shown in FIG. 5. Next, the eight heat-transfer tubes 1*b* were assembled in the EGR gas cooling apparatus as in Embodiment 2 and was subjected to the cooling tests under the common conditions. The results have revealed that a heat-exchanging efficiency was slightly lowered, as compared with Embodiment 2, but that the cooling efficiency was practically sufficient.

Embodiment 4

A fin structure 2*c* was prepared substantially like Embodiment 3 excepting that a plurality of raised portions 2*c*-1 of a rectangular shape were formed, as shown in FIG. 8, and that the remaining portions are raised toward passages 3*c* thereby to form a plurality of raised fins 2*c*-2 protruding in a tongue shape toward the upstream of the passage 3*c*. Means for preparing the fin structure 2*c* in this embodiment need no complicated plastic working as in Embodiment 2 but is sufficed by the simple punch working as the means for forming the raised portions 2*c*-1, so that the cost for manufacturing the fin structure 2*c* can be drastically lowered. This fin structure 2*c* was inserted into and jointed to the flat heat-transfer tube as in Embodiment 3 so that eight heat-transfer tubes (although not shown) according to this embodiment each having the fin structure 2*c* housed therein were obtained. These eight heat-transfer tubes 1*c* obtained were assembled as in Embodiment 3 in the shell-and-tube type heat exchanger for the EGR gas cooling apparatus and were subjected to cooling tests under the common conditions. The results have revealed that the interflow of the hot fluid was impossible but the edge effect to be caused by the plurality of raised fins 2*c*-2 protruding in the tongue shape in the passages 3*c* acted to separate all the laminar flows of the hot EGR gas flowing in the passages 3*c* thereby to obtain a cooling efficiency substantially equivalent to that of Embodiment 3.

Embodiment 5

A fin structure 2*d* was prepared substantially equivalent to that of Embodiment 4 excepting that the raised portion 2*c*-1 of Embodiment 4 was a triangular raised portion 2*d*-1 in this embodiment, as shown in FIG. 9, that a plurality of raised fins 2*d*-2 protruding in a tongue shape toward the upstream of a passage 3*d* were triangular. The (not-shown) heat-transfer tube 2*d* was obtained by similar housing means or the like for that fin structure 2*d*. This fin structure 2*d* was assembled in the shell-and-tube type heat exchanger for an EGR gas cooling apparatus like that of Embodiment 4 and was subjected to the cooling tests of the EGR gas under the common conditions. The results have revealed that a cooling efficiency substantially identical to that of Embodiment 4 was obtained.

Embodiment 6

A fin structure 2*e* according to this embodiment was prepared substantially similarly to Embodiment 2 excepting that the plate fin having a square section was undulated to have a curved line in the longitudinal direction as in Embodiments 1 and 2 to have such troughs and ridges 2*e*-3 and 2*e*-4 on the side walls of the corner portions corresponding to the undulating ridges of the plate fin that the ridges and the troughs alternate with respect to their inside passages 3*e*, as shown at FIG. 10A and FIG. 10B, and that the through holes 4 were not formed in those side walls. The fin structure 2*e* was housed in the flat heat-transfer tube like that of Embodiment 2 and was assembled for the cooling tests under the common conditions like the same embodiment in the shell-and-tube type heat exchanger for the EGR gas cooling apparatus. The tests have revealed that the plural troughs and ridges 2*e*-3 and 2*e*-4 extending vertically of the side walls were alternately formed on the corner portion of the curved face in the fluid passage 3*e* although the interflow of the hot fluid was impossible, and that turbulences and vortexes were established in the flowing fluid so that a practically sufficient cooling efficiency could be obtained by the stirring actions higher than the expected ones. Here, the troughs and ridges 2*e*-3 and 2*e*-4 according to this embodiment were formed at the corner portion. It is, however, not precluded from forming those ridges and troughs at the remaining portions other than the corner portion and microwave-like continuous troughs and ridges 2*e*-5 of an entire corrugated part Embodiment 7

This embodiment employing the heat-transfer tube 1, as obtained according to any of Embodiments 1 to 6, in an EGR gas cooling apparatus 50 to be assembled in a cooled EGR system of an automobile is described with reference to FIG. 11. In the EGR gas cooling apparatus 50 according to this embodiment, a group of heat-transfer tubes in a shell body 51 is formed by connecting a pair of tube sheets 50-3 and 50-4 to the two ends of a shell body 51 to seal up the inside, and by connecting and arranging the plural flat heat-transfer tubes 1 obtained by the foregoing embodiments between the paired tube sheets 50-3 and 50-4 individually at a predetermined spacing through the tube sheets 50-3 and 50-4. On the two sides of the shell body 51, moreover, there are mounted bonnets 50-1 and 50-2, which are provided with an inflow port G-1 and an outflow port G-2 for an EGR gas G. On the other hand, the shell body 51 is provided at the two end portions of its outer circumference with an inlet W1 and an outlet W2 for a cooling medium such as engine cooling water or cooling wind, e.g., engine cooling water W in this embodiment. The gas-tight space, which is defined by the paired tube sheets 50-3 and 50-4, is provided as a heat-exchanging area Wa, in which the engine cooling water W can flow. By jointing a plurality of support plates 50-5 in the heat-exchanging area Wa and by inserting the heat-transfer tube 1 into an elliptical through hole in the support plate 50-5, the heat-transfer tube 1 is stably supported as the baffle plate, and the flow of the cooling water W to flow in the heat-exchanging area Wa is forced to meander. At this time, the fin structure connected and fixed is housed in advance by a soldering in the inner circumference of the heat-transfer tube 1 to be assembled in the shell body 51. The joint of the fin structure by the soldering could also be performed after the assembling in the shell body 51.

In the EGR gas cooling apparatus 50 thus constructed according to this embodiment, the hot EGR gas G to flow from the EGR gas inflow port G-1 into the shell body 51 flows into the plural heat-transfer tubes 1 arranged in the shell body 51. However, the engine cooling water W has flown into the heat-exchanging area Wa, which is formed around the heat-transfer tube group of the heat-transfer tubes 1 arranged at the predetermined spacing so that the heat exchange between the EGR gas G and the engine cooling water W through the walls of the heat-transfer tubes 1 is instantly started. In this embodiment, the flat tube having the wide heat-transfer area was adopted as the heat-transfer tube 1, and the fin structure 2, as exemplified in the aforementioned individual embodiments, was fitted in the inner circumference of the flat heat-transfer tube. As a result, the excellent cooling efficiency was verified such that the stirring action, the separation of laminar flows, the dispersion, and the homogeneous flow rate and velocity of the fluid acted so synergetically as to promote the heat exchange between the EGR gas G and the engine cooling water W efficiently thereby to verify the excellent cooling efficiency.

(Comparison 1)

A fin structure 12 was prepared as in Embodiment 3 excepting that no through hole was formed in the side walls of the fin structure, as shown in FIG. 13. Eight flat heat-transfer tubes 10 having the fin structure 12 housed therein, as shown in FIG. 12, were obtained by fitting the fin structures 12 in the flat tube like that of Embodiment 3 and by jointing them integrally by means like that of Embodiment 3. Next, the eight heat-transfer tubes 10 were assembled in the EGR gas G cooling apparatus, as in Embodiment 3, and were subjected to the cooling tests under the common conditions. It has been confirmed, as shown in FIG. 14, that an apparent deviation was found in the flow rate distribution and the flow velocity distribution of the EGR gas to flow in the small passages 13 of the heat-transfer tube 10 so that the heat-exchanging efficiency was drastically lowered, as compared with that of Embodiment 3.

(Comparison 2)

A corrugated fin structure 12*a* was prepared as in Embodiment 1 excepting that no through hole was formed in the side walls of the fin structure, as shown in FIG. 15. Eight flat heat-transfer tubes 10*a* each having the corrugated fin structure 12*a* housed therein, as shown in FIG. 15, were obtained by fitting the corrugated fin structure 12*a* in the flat tube like that of Embodiment 1 and by jointing them integrally by means like that of Embodiment 1. Next, the eight heat-transfer tubes 10*a* were assembled as in Embodiment 1 in the EGR gas cooling apparatus and were subjected to the cooling tests under the common conditions. It has been confirmed that an apparent deviation was found in the flow rate distribution and the flow velocity distribution of the EGR gas to flow in the small passages 13*a* of the flat heat-transfer tube 10*a* obtained so that the heat-exchanging efficiency was apparently lower than that of Embodiment 1, although the corrugated fin structure 12*a* fabricated by applying the plastic working of an excessively high production cost was fitted in the flat tube.

The means for fixing the fin structure obtained in each of the foregoing embodiments based on the invention in the various flat heat-transfer tubes is arbitrary but not especially limitative. Generally, the soldering is adopted for jointing the fin structure and the flat heat-transfer tube, and the welding or soldering is preferably adopted for the joint between the flat heat-transfer tube and the cooling jacket (or shell body) or the bonnet portion (or duct) or the like. In the foregoing individual embodiments according to the invention, moreover, the EGR gas or the cooled medium is exclusively exemplified by the fluid to flow in the heat-transfer tube. In another embodiment, the cooling water or the cooling medium is fed into the heat-transfer tube so that the outside of the heat-transfer tube can provide the gas passage for the cooled medium. In this case, turbulences and vortexes can be established in the cooling water to flow in the heat-transfer tube thereby to efficiently exchange the heat of the gas to contact with the outer circumference face of the heat-transfer tube.

Here, the notches, the through holes, the raised portions, the ridges and troughs and so on, as formed on the side or the upper or lower wall of the fin structure are exemplified in the foregoing individual embodiments by only the single shapes. It is, however, preferred that they are formed to match a plurality of shapes in the passage of one plate fin. In addition of the notches 2-1 in Embodiment 1, for example, the troughs 2*e*-3 and/or ridges 2*e*-4 could be additionally formed. Alternatively, both the raised fins 2*c*-2 in Embodiment 4 and the raised fins 2*d*-2 in Embodiment 5 can also be arrayed in addition to the through holes 4*a* of Embodiment 3 so that the synergetic effects can be expected from that structure. In the foregoing individual embodiments, moreover, the notches, through holes, raised portions and soon to be formed are simple rectangular, triangular or circular. If desired, however, it is not precluded from selecting V-shaped notches or star-shaped or polygonal through holes suitably. It also goes without saying that the notches, the through holes, the raised portions, the ridges and troughs, and the like in the individual embodiments may be worked at any timing before and after the corrugating operations.

According the foregoing fin structure of the invention, as apparent from the foregoing individual embodiments and comparisons, at least one notch, through hole, raised portion, ridge and trough and the like is formed either by itself or in combination on the side of the plate fin which is housed in the flat heat-transfer tube and which divides the passage of the fluid either the cooled medium or the cooling medium to flow in the heat-transfer tube into the plural small passages having the square section and the free shape in the longitudinal direction. In the adjoining small passages, the flowing fluids flow into each other so that the flow of the flat direction in the flat heat-transfer tube is freed. As a result, no deviation in the flow velocities of the flows in the small passages divided from the heat-transfer tube is established to make no accompanying distribution in the flow velocity. Thus, the structure can keep the uniform flow velocity. Moreover, the pressure of the fluid is uniform between the individual passages divided into the small passages so that the distribution of the fluid is averaged to improve the heat-exchanging performance.

According to the flat heat-transfer tube having the fin structure of the invention housed therein, moreover, the fluid can freely flow into and out of the small passages partitioned by the notches, the through holes and so on formed in the sides of the fin structure. As a result, the mixing and collision between the fluids frequently can occur to establish the turbulences and vortexes of the working fluid, and the flow lines of the fluid are complicatedly disturbed to separate the laminar flow to repeat the stirring actions so that the fluid to flow in the heat-transfer tube repeats the contact with the heat-transfer tube wall thereby to cause the heat exchange effectively. In addition, the end portions to be formed of the aforementioned notches, through holes, raised portions, the ridges and troughs and so on cause the heat-exchanging edge effects and the fluid stirring actions so that the heat-exchanging performance can be better improved. Thus, the fin structure according to the invention can be properly housed as the fluid stirring plate fin in not only the shell-and-tube type heat-exchanging cooling apparatus but also the heat exchanger for recovering the waste heat from the exhaust gas, or the heat-exchanging heat-transfer tube of an EGR gas cooler, a fuel cooler, an oil cooler, an inter cooler or the like. At the same time, the heat-transfer tube having the fin structure housed therein and the shell-and-tube type heat exchanger having the heat-transfer tube assembled therein are enabled to reduce the sizes and weights of those apparatus by their excellent heat-exchanging performance and to contribute the compactness of the apparatus. Thus, the heat exchanger, which can be easily installed in a limited space, can be provided at a relatively low cost so that its wide application to the relevant field can be expected.

What is claimed is:

1. A heat-transfer assembly comprising:

a heat-transfer tube having opposite ends, opposite top and bottom panels extending between the ends and opposite sides joining the top and bottom panels;

a fin structure housed in the heat-transfer tube and being formed from a plate corrugated to define a plurality of small passages, extending between the opposite ends of the heat-transfer tube, each of the passages having opposite side walls defined by the fin structure, a first transverse wall defined by the fin structure and extending between the side walls of the respective passage and a second transverse wall defined by one of the top and bottom panels of the heat-transfer tube and extending between the side walls of the respective passage, at least one structure for improving heat-transfer, the structure being selected from the group consisting of:

notches formed through the side walls of the passages, through holes formed through the side walls of the passages, raised portions formed in the transverse walls and extending into the respective passage, and ridges and troughs formed in the side walls and extending substantially normal to the top and bottom panels of the heat-transfer tube.

2. The heat-transfer assembly as set forth in claim 1, wherein said plural small passages in said heat-transfer tube are curved in the longitudinal direction.

3. The heat-transfer assembly as set forth in claim 2, wherein the fin structure housed in said heat-transfer tube is made of one thin metal sheet, and in that the structure for facilitating heat-transfer is formed by mechanical working or chemical working.

4. The heat-transfer assembly as set forth in claim 1, wherein the fin structure housed in said heat-transfer tube is made of one thin metal sheet, and in that the structure for facilitating heat-transfer is formed by mechanical working.

5. The heat-transfer assembly as set forth in claim 1, wherein said fin structure is secured in the heat-transfer tube is by welding or soldering so that the fin structure is integrally jointed to the heat-transfer tube.

6. The heat-transfer assembly as set forth in claim 1, wherein said ridges and troughs are provided through an entire area of the side walls.

7. The heat-transfer assembly as set forth in claim 1, wherein said plural small passages formed by the fin structure housed in said flat heat-transfer tube are straight in the longitudinal direction.

8. The heat-transfer assembly as set forth in claim 1, wherein the fin structure housed in said heat-transfer tube is made of one thin metal sheet, and in that the structure for facilitating heat-transfer is formed by chemical working.

9. The heat-transfer assembly as set forth in claim 1, wherein the structure for enhancing heat-transfer includes the notches formed in the side walls of the passages, each said notch extending from the transverse wall of the respective passage to the corresponding top or bottom walls of the heat transfer tube defining the respective passage.

10. The heat-transfer assembly of claim 1, wherein the structure for facilitating heat-transfer includes the through holes formed through the side walls of the passages, each said through hole being at a position on the side walls spaced from the transverse wall of the respective passage and from the top or bottom walls of the heat transfer tube.

11. The heat-transfer assembly of claim 1, wherein the structure for facilitating heat-transfer includes the raised portions, each raised portion being defined by a cut in the respective transverse wall of the fin structure and bending the cut portion of the transverse wall into the respective passages.

12. The heat-transfer assembly as set forth in claim 1, wherein the structure for enhancing heat-transfer includes the ridges and troughs, the ridges and troughs being disposed in an alternating array and being aligned substantially parallel to one another and substantially normal to the top and bottom walls of the heat transfer tube.

* * * * *